US005244111A

United States Patent [19]

Merom

[11] Patent Number: 5,244,111

[45] Date of Patent: Sep. 14, 1993

[54] BEVERAGE CAN CLEANER

[76] Inventor: Rudi Merom, 28-07 Zachary Ter., Fair Lawn, N.J. 07410

[21] Appl. No.: 41,852

[22] Filed: Apr. 2, 1993

[51] Int. Cl.[5] ..... B65D 25/00

[52] U.S. Cl. ..... 220/694; 220/906

[58] Field of Search ..... 220/694, 906, 267, 274

[56] References Cited

U.S. PATENT DOCUMENTS

| | | | |
|---|---|---|---|
| 1,979,171 | 10/1934 | O'Neil | 220/274 |
| 2,015,028 | 9/1935 | Gillette | 220/694 X |
| 3,825,151 | 7/1974 | Annaud | 220/906 X |

*Primary Examiner*—Steven M. Pollard
*Attorney, Agent, or Firm*—Alfred C. Hill

[57] ABSTRACT

A device to clean the circumferential groove having a predetermined shape formed in the top of a beverage can by the joining of the top and side wall of the can when the can is manufactured comprising a first portion slideably engaging a circumferential lip contiguous with the outer edge of the groove; and a second portion connected to the first portion with the second portion being configured to conform to the shape of the groove; the first and second portions being slid circumferentially about the lip and the groove to clean the groove.

3 Claims, 1 Drawing Sheet

FIG. 2
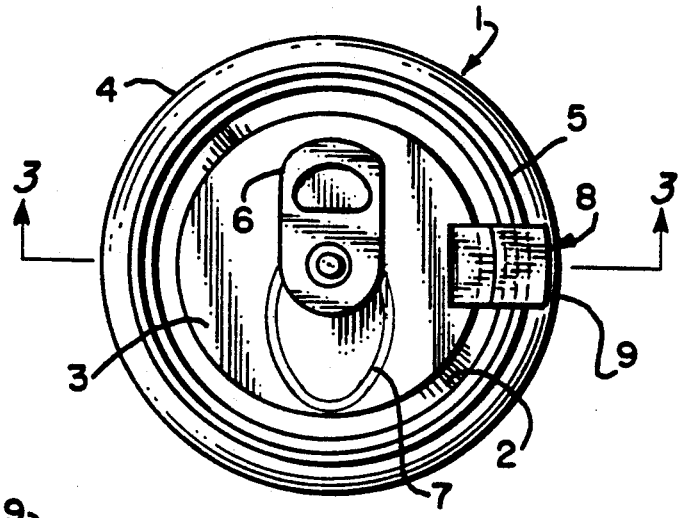
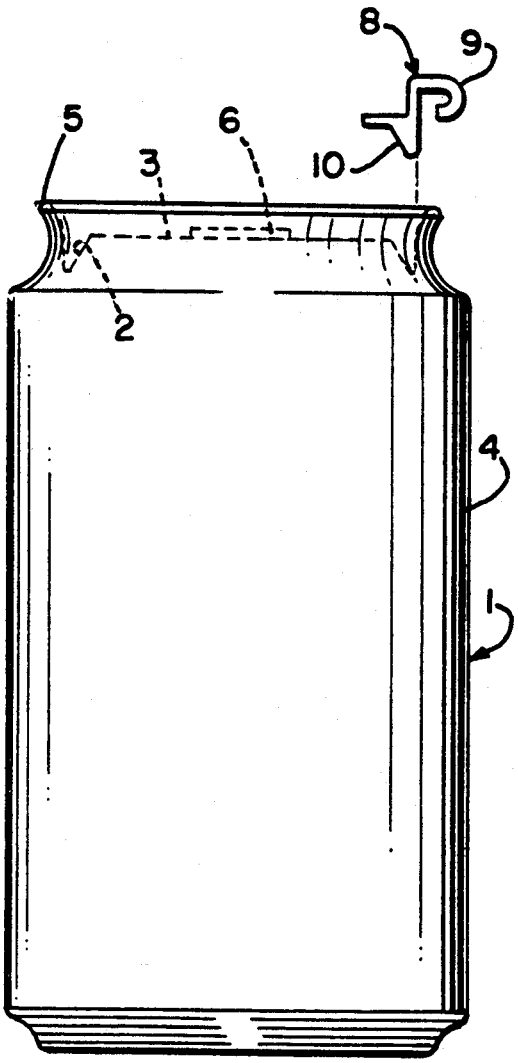
FIG. 1
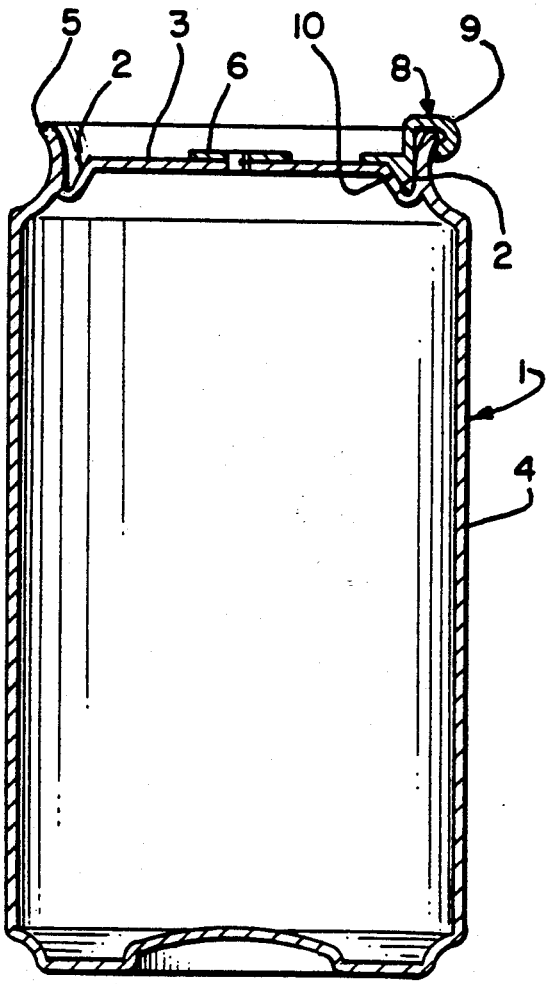
FIG. 3

BEVERAGE CAN CLEANER

BACKGROUND OF THE INVENTION

The present invention relates to beverage cans and more particularly to a cleaner for the groove formed in the top of the beverage can when manufactured.

Beverage cans on the market today employ a tab and serrated lines in the top thereof to enable easy opening by the consumer of the beverage. In the manufacture of such cans, a groove is formed around the circumference of the top of a can due to the method of the manufacturing of the can when the top and side walls are joined to form the can. This groove tends to accumulate dirt during shipping and/or from the surrounding environment. It is known by those that consume beverages from such a can directly that they have trouble cleaning this particular groove due to its deepness and narrowness of the bottom of the groove. It is of course desirable to clean the groove when drinking directly from the can so that the beverage does not pick up this dirt. Due to the depth and the narrowness of this groove, it is very difficult to clean the groove using a paper or fabric product.

SUMMARY OF THE INVENTION

An object of the present invention is to provide a device to clean the circumferential groove formed in the top of a beverage can.

A feature of the present invention is the provision of a device to clean a circumferential groove having a predetermined shape formed in the top of a beverage can by the joining of the top and side wall of the beverage can when the can is manufactured comprising a first portion slideably engaging a circumferential lip contiguous with an outer edge of the groove; and a second portion connected with the first portion, the second portion being configured to conform to the shape of the groove; the first and second portion being slid circumferentially about the lip and the groove to clean the groove.

BRIEF DESCRIPTION OF THE DRAWING

Above-mentioned and other features and objects of the present invention will become more apparent by reference to the following description taken in conjunction with the accompanying drawing, in which:

FIG. 1 is a side view of a beverage can incorporating the cleaning device in accordance with the principles of the present invention;

FIG. 2 is a top view of the can of FIG. 1 with the cleaning device in position on the lip formed in the top of the beverage can in accordance with the principles of the present invention; and FIG. 3 is a cross-sectional view taken along line 3—3 of FIG. 2.

DESCRIPTION OF THE PREFERRED EMBODIMENTS

Referring to FIGS. 1, 2 and 3, beverage can 1 has a groove 2 in the top thereof that is formed therein when top 3 and side wall 4 of can 1 is sealed together during the course of manufacture. When this connection and seal of can 1 is made a lip 5 is formed in the top of can 1. Also during the manufacture of can 1, where the beverage is to be directly drank from can 1, a tab 6 and a score lines 7 are provided to enable the consumer of the beverage to easily open the can.

As mentioned above groove 2 is relatively deep and narrow at the bottom thereof so that it is very difficult to clean groove 2 that may have been contaminated with dirt during storage and shipping.

In accordance with the principles of the present invention, groove 2 can be easily cleaned by a can cleaner 8 that includes a first portion 9 slideably engaging circumferential lip 5 contiguous with an outer edge of groove 2 and a second portion 10 connected to the first portion 9 with second portion 10 being configured to conform to the shape of groove 2. Sliding can cleaner 8 circumferentially about lip 5 and groove 2, groove 2 can be easily cleaned. Can cleaner 8 can be slid circumferentially in either direction about the circumference of lip 5 and groove 2.

The material that can cleaner 8 is made of would be consistent with the ability to grip lip 5 by portion 9, such as a spring type material, and portion 10 can be provided by a fabric type material or some material that has a cleaning action upon metal.

Cleaning device 8 can be provided as a permanent attachment to can 1 during the course of manufacture of can 1 as illustrated in FIG. 3, or cleaning device 8 can be an accessary for can 1 to enable cleaning of groove 2, such as illustrated in FIG. 1 wherein cleaning device 8 is sold along with can 2, but disengaged from lip 5. When this accessary is in use, device 8 would be removed from its shipping position on can 1 and inserted to engage groove 2 and lip 5 to enable the cleaning of groove 2 by the circumferential sliding of device 8 in groove 2 and around lip 5.

While I have described above the principle of my invention in connection with specific apparatus, it is to be clearly understood that this description is made only by way of example and not as a limitation to the scope of my invention as set forth in the objects thereof and in the accompanying claims.

I claim:

1. A device to clean a circumferential groove having a predetermined shape formed in a top of a beverage can by the joining of said top and side wall of said can when said can is manufactured comprising:

a first portion slideably engaging a circumferential lip contiguous with an outer edge of said groove; and a second portion connected to said first portion, said second portion being configured to conform to said shape of said groove;

said first and second portions being slid circumferentially about said lip and said groove to clean said groove.

2. A device according to claim 1, wherein said first and second portions are a permanent attachment to said can.

3. A device according to claim 1, wherein said first and second portions are an accessary for said can.

* * * * *